United States Patent [19]

Scholz

[11] Patent Number: 4,686,421

[45] Date of Patent: Aug. 11, 1987

[54] GLOW DISCHARGE STARTER AND ARC DISCHARGE LAMP CONTAINING SAME

[75] Inventor: John A. Scholz, Danvers, Mass.

[73] Assignee: GTE Products Corporation, Danvers, Mass.

[21] Appl. No.: 739,347

[22] Filed: May 30, 1985

[51] Int. Cl.[4] ..... H01J 61/52

[52] U.S. Cl. ..... 315/73; 315/72; 313/553; 313/560; 313/561

[58] Field of Search ..... 313/553, 556, 558, 559, 313/560, 561; 315/72, 73

[56] References Cited

U.S. PATENT DOCUMENTS

| | | | |
|---|---|---|---|
| 2,206,649 | 7/1940 | Senauke | 313/561 |
| 2,285,805 | 6/1942 | Chirelstein | 313/560 |
| 2,625,622 | 1/1953 | Rixton | 313/558 |
| 3,086,137 | 4/1963 | Eicken | 313/560 |
| 3,485,343 | 12/1969 | Jorgensen | 313/559 |
| 3,519,864 | 7/1970 | Gungle et al. | 313/560 |
| 3,737,710 | 6/1973 | Waymouth et al. | 313/553 |
| 4,277,725 | 7/1981 | Sneijers | 315/73 |
| 4,377,771 | 3/1983 | Van Vliet | 315/47 |
| 4,620,129 | 10/1986 | Luthra | 313/630 |

FOREIGN PATENT DOCUMENTS

| | | | |
|---|---|---|---|
| 44-28148 | 11/1969 | Japan | 315/73 |
| 46-32116 | 9/1971 | Japan | 315/73 |

*Primary Examiner*—David K. Moore
*Assistant Examiner*—Michael Razavi
*Attorney, Agent, or Firm*—Carlo S. Bessone

[57] ABSTRACT

This invention relates to a glow discharge starter having a sealed envelope containing an ionizable medium, a bimetallic electrode and a counter electrode located within the envelope. A getter holder is secured to one of the electrodes adjacent the internal surface of the envelope. An arc discharge lamp employing the improved glow discharge starter as part of a starting circuit is described.

11 Claims, 5 Drawing Figures

GLOW DISCHARGE STARTER AND ARC DISCHARGE LAMP CONTAINING SAME

TECHNICAL FIELD

This invention relates in general to a glow discharge starter for starting an arc discharge lamp. The invention furthermore relates to a discharge lamp having a glow discharge starter according to the invention.

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode. When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge starter sequence is repeated until lamp ignition occurs.

A glow discharge starter of the aforementioned type is described, for example, in the book "Light Sources" by Elenbaas, Philips Technical Library, pages 102–103. Other types of glow discharge starters are shown in U.S. Pat. Nos. 2,930,872; 2,930,873; and 3,887,847.

Glow discharge starters, included as part of an arc discharge lamp, are shown in U.S. Pat. Nos. 4,117,370; 4,144,475; 4,277,725; 4,377,771, and 4,374,339.

It is known to include a getter within the glow discharge starter, for example, to prevent breakdown or to remove deleterious gases that may form during processing or during operation of the glow discharge starter. U.S. Pat. No. 4,377,771 shows a starter containing a reversible getter which gives off a gas when the temperature increases and absorbs the gas when the temperatures decreases.

Many commercially available glow discharge starters contain a getter holder centrally located at the end of the starter envelope remote from the exhaust end or stem press. The getter holder consists of a small piece of metal in which a cup is formed therein. The cup contains a getter mixture which, for example, may comprise barium, magnesium and thorium. During fabrication and processing, the getter mixture contained within the cup of the getter holder is "flashed" onto the internal surface of the envelope and internal parts of the glow discharge starter. Flashing is a known process accomplished by means of a radio frequency generator commonly referred to as a bomber. The above mentioned process creates a more effective surface area for improved gettering of deleterious gases within the glow discharge starter. An example of the above mentioned glow discharge starter is the GB-HS starter manufactured by GTE Sylvania S.A. in San Jose, Costa Rica.

It was observed that the life of the glow discharge starter is a function of the residual gas content contained within the starter envelope. It was discovered that during operation of the glow discharge starter of the type described above, components of the fill gas are entrapped by the residual getter mixture remaining in the getter strip cup after flashing. The interior of the getter strip cup after flashing resembles a pitted and cracked surface composed of residual getter components. It is speculated that the catalytic activity, adsorption or absorption of the residual getter mixture remaining in the cup, may be enhanced by the increased surface area resulting from the crevices, edges and corners produced within the cup. It is also speculated that the created glow discharge in the glow discharge starter leads to ionization of the rare gases contained in the starter envelope. The ionized gases may then be accelerated (owing to the applied potential across the glow discharge starter electrodes) into the relatively high surface area of the residual getter remaining in the cup, which is positioned within the main glow discharge. Entrapment of the fill gas components in the residual getter mixture results in early glow discharge starter failures.

SUMMARY OF THE INVENTION

It is, therefore, an object of the invention to obviate the disadvantages of the prior art.

It is another object of the invention to provide an improved glow discharge starter having an increased life.

It is still another object of the invention to provide an arc discharge lamp including an improved glow discharge starter.

These objects are accomplished, in one aspect of the invention, by the provision of a glow discharge starter comprising a sealed envelope containing an ionizable medium, a bimetallic electrode and a counter electrode located within the sealed envelope and a getter holder secured to one of the electrodes and being adjacent the internal surface of the envelope.

In accordance with further aspects of the invention, the bimetallic electrode comprises a connecting member having a contact means formed in or secured to one end of the connecting member and a bimetallic element having a first end secured to the other end of the connecting member and a second end secured to a post.

In accordance with further teachings of the present invention, the getter holder comprises a getter holder strip having a getter cup formed therein or secured thereto for holding a predetermined amount of getter material. In one embodiment, the getter cup has an opening and the opening faces the internal surface of the sealed envelope.

In accordance with further embodiments of the invention, the getter holder is preferably secured to the counter electrode or the bimetallic electrode.

In accordance with additional aspects of this invention, an arc discharge lamp, preferably high pressure sodium, is provided comprising an hermetically sealed outer envelope having a base portion at one end, with at least a pair of lead-in conductors extending therefrom into the envelope. An hermetically sealed elongated arc tube is disposed coaxially within the outer envelope. The arc tube has first and second external conductive terminals at respective ends which are connected to electrodes disposed within the arc tube. Respective means within the outer envelope electrically connect the pair of lead-in conductors to the first and second terminals of the arc tube. A circuit for starting a discharge in the discharge tube is electrically connected in series with the first and second terminals of the arc tube, and includes a glow discharge starter comprising a sealed envelope containing an ionizable medium, a bimetallic electrode and a counter electrode located within the envelope. A getter holder is secured to one of the electrodes and is adjacent the internal surface of the envelope.

In accordance with still further aspects of the invention, the glow discharge starter is located within the hermetically sealed outer envelope.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
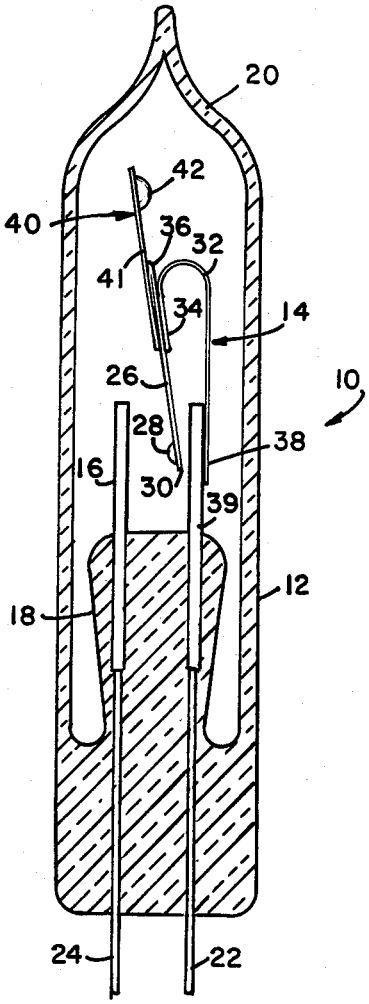
(PRIOR ART) FIG. 1
FIG. 1 is a sectional view of a prior art glow discharge starter.

Referring now to the drawings with greater particularity, there is shown in FIG. 1 a prior art glow discharge strater 10 of the type previously mentioned. Glow discharge starter 10 consists of a sealed envelope 12 containing an ionizable medium. A bimetallic electrode 14 and a counter electrode 16 are located within envelope 12. Electrodes 14 and 16 are electrically connected to lead-in conductors 22 and 24, respectively. Bimetallic electrode 14 comprises a connecting member 26 having a contact 28 secured to one end 30 of connecting member 26 and a bimetallic element 32 having a first end 34 secured to the other end 36 of connecting member 26 and a second end 38 secured to a post 39 connected to lead-in conductor 22.

Further included in glow discharge starter 10 is a getter holder 40 secured to connecting member 26 of bimetallic electrode 14. Getter holder 40 comprises a getter holder strip 41 having a getter cup 42 formed therein for holding a predetermined amount of getter material. Getter holder cup 42 in the prior art (FIG. 1) is positioned within the main glow discharge which extends longitudinally within envelope 12 in a cylindrically shaped area between electrodes 14 and 16 from stem press 18 to the remote end 20 of the glow discharge starter 10. During fabrication and processing, the getter mixture contained within cup 42 of getter holder 40 is "flashed" onto the internal surface of the envelope 12 and internal parts of the glow discharge starter.

Figure 2:
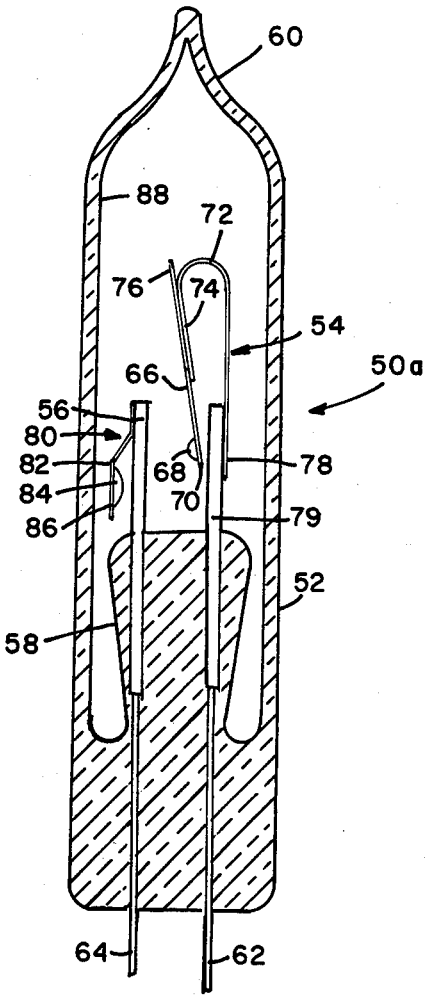
FIG. 2 is a sectional view of one embodiment of a glow discharge starter according to the invention.

In accordance with an embodiment of the invention as shown in FIG. 2, glow discharge starter **50*a* comprises a sealed envelope 52 containing an ionizable medium such as a mixture of helium and argon. A bimetallic electrode 54 and a counter electrode 56 are located within envelope 52. Electrodes 54 and 56 are electrically connected to lead-in conductors 62 and 64, respectively. Bimetallic electrode 54 preferably comprises a connecting member 66 having a contact means 68 formed in or secured to one end 70 of connecting member 66 and a bimetallic element 72 having a first end 74 secured to the other end 76 of connecting member 66 and a second end 78 secured to a post 79 connected to lead-in conductor 62. Connecting member 66 and contact means 68 can be formed directly from bimetallic element 72. Counter electrode 56** can be constructed as a second bimetallic electrode.

Further included in glow discharge starter 50a is a getter holder 80. Getter holder 80 comprises a getter holder strip 82 having a getter cup 84 formed therein or secured thereto for holding a predetermined amount of getter material. The getter material may include a 0.75 mg. mixture of 28% barium, 72% magnesium with 6% thorium added to the barium/magnesium mixture. Getter holder 80, according to the invention, is secured to one of the electrodes (54,56) and positioned adjacent the internal surface 88 of envelope 52, external to a cylindrically shaped area defined between electrodes 54 and 56 which extends longitudinally from the stem press 58 to the remote end 60 of glow discharge starter **50*a*, 50*b*, 50*c*. Preferably, the opening 86 of getter cup 84 is positioned so as to face the internal surface 88 of sealed envelope 52. Opening 86 of getter cup 84 located on getter holder strip 82 of getter holder 80 is preferably spaced approximately 0.4 mm from internal surface 88 of sealed envelope 52**.

In a preferred embodiment as shown in FIG. 2, getter holder 80 of glow discharge starter **50*a* is secured to counter electrode 56** by welding.

Figure 3:
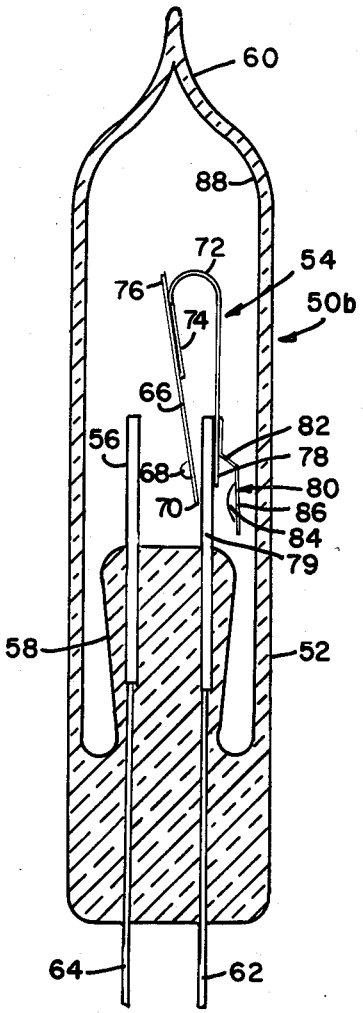
FIG. 3 is a sectional view of another embodiment of a glow discharge starter according to the invention.
Figure 4:
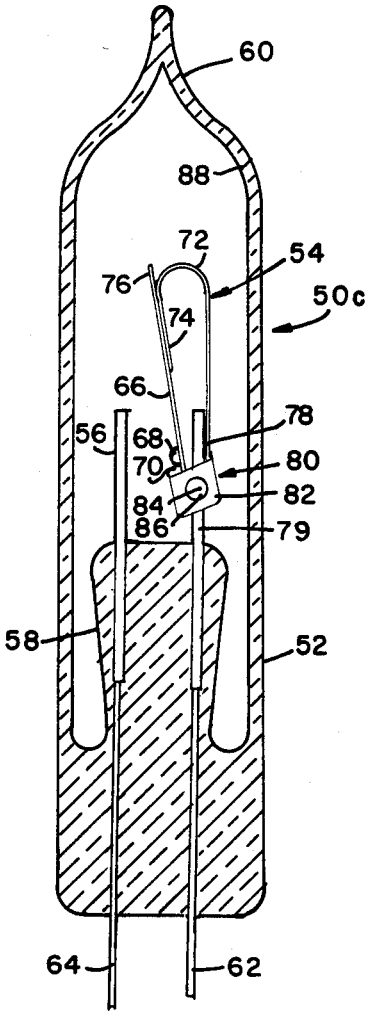
FIG. 4 is a sectional view of another embodiment of a glow discharge starter according to the invention.

FIGS. 3 and 4 show further embodiments; corresponding components are referred to by the same reference numerals as used in FIG. 2. In lamp **50*b* shown in FIG. 3, getter holder 80 is secured to bimetallic electrode 54. Getter holder 80 in glow discharge starter 50*c* is secured to bimetallic electrode 54 by wrapping getter holder strip 82 around post 79**.

It is believed that locating the getter cup in close proximity to the confining interior surface of the envelope (as shown in FIGS. 2–4) will quench the glow discharge that occurs within the glow discharge starter when a potential is applied. The glow discharge will be centralized within the envelope allowing the desired movement of the bimetallic electrode; but owing to the cooler glass wall, the flow will be reduced in the immediate surroundings of the open getter cup.

Samples of glow discharge starters were constructed according to the teachings of the invention. A helium-argon-hydrogen gas mixture at a manifold fill pressure of 100 torr was used for all samples. The glow discharge starters were life-tested on an apparatus which operated the individual starters (with associated ballasting) on a cycle of 0.750 seconds on, 14.250 seconds off, for a total cycle time of 15 seconds. Using this apparatus, end of life is defined as when the glow discharge starter does not produce voltage pulses within the 0.750 second on duty cycle.

The effect upon life cycles of the glow discharge starters having a construction as depicted in FIGS. 2–4 as compared to the prior art (control) construction as depicted in FIG. 1 is shown in Table I.

TABLE I

| Glow Discharge Starter Number | Average Life Cycles | Percent Increase Over Control |
|---|---|---|
| 10 (control) | 1350 | — |
| 50a | 2000 | 48.1 |
| 50b | 2050 | 51.8 |
| 50c | 2075 | 53.7 |

Table I above shows a significant improvement in life for glow discharge starters **50*a*, 50*b* and 50*c* over the prior art control starter 10**. Improvements in the life of the glow discharge starter can consequently affect the life of an arc discharge lamp, to be described hereinafter, containing a glow discharge starter according to the invention.

Figure 5:
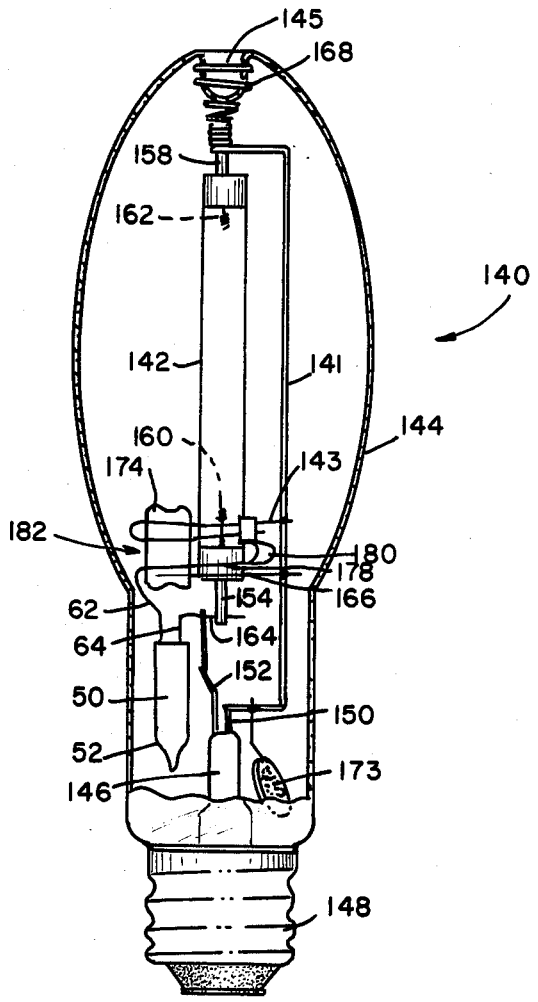
FIG. 5 is a perspective view, with a partly cut-away outer envelope, of an arc discharge lamp having a glow discharge starter according to the invention.

Referring to FIG. 5, a high pressure sodium vapor arc discharge lamp 140 according to one embodiment of the invention comprises an hermetically sealed elongated arc tube 142, typically a polycrystalline alumina creamic, disposed coaxially within an hermetically sealed outer glass envelope 144 having a reentrant stem press 146 and a standard screw base 148 attached to the stem end of the outer envelope. Heavy lead-in conductors 150 and 152 are supported in the stem press 146 and are connected to the base 148 in the usual manner.

The arc tube 142 has a first external conductive terminal 154 and a second external conductive terminal 158 located at respective ends thereof. The terminals 154 and 158 comprise niobium feed-through tubes which respectively support and are connected to electrodes 160 and 162 within arc tube 142.

Electrical connection to arc tube 142 is provided via lead-in conductor 152, conductor 164 and terminal 154 to the electrode 160. In order to electrically connect the lead-in conductor 150 to terminal 158 and electrode 162 of arc tube 142, a support rod 141 has respective ends connected to lead-in conductor 150 and terminal 158.

A coiled spring 168 is disposed in partially compressed state within the outer envelope 144 between the top end of the arc tube 142 and a dimple 145 formed in outer envelope 144 whereby the terminal 158 is securely engaged to coaxially center and stabilize the arc tube 142.

Disposed at the lower end of the lamp, and supported on support rod 141 are one or more getters 173.

In accordance with an embodiment of the invention, a circuit 182 for starting arc discharge lamp 140 is electrically connected in series with first external conductive terminal 154 and second external conductive terminal 158 located at respective first and second ends of elongated arc tube 142. The starting circuit 182 includes a glow discharge starter 50. The construction of the glow discharge starter 50 corresponds to one of the glow discharge starter embodiments shown in FIGS. 2–4; corresponding components are referred to by the same reference numerals. Glow discharge starter 50 comprises a sealed envelope 52 containing an ionizable medium, a bimetallic electrode (not shown) and a counter electrode (not shown) located within envelope 52, and a getter holder (not shown) secured to one of the electrodes and being adjacent the internal surface of envelope 52.

In FIG. 5, glow discharge starter 50 is located within hermetically sealed outer envelope 144. Alternatively, glow discharge starter 50 can be located within a housing or base 148. In the latter case, an additional lead-in conductor supported by stem press 146 may be necessary to provide electrical connection for lead-in conductor 62.

Preferably, the circuit 182 for starting arc discharge lamp 140 further includes a bimetallic switch 180 electrically connected in series combination with glow discharge starter 50. A "U" shaped bimetallic switch 180, as shown in FIG. 5, is welded to a first support wire 143 which is embedded in a quartz rod 174. One end of first support wire 143 is welded to support rod 141. Quartz rod 174 is also supported by a second support wire 166 embedded therein and welded at one end to rod 141. At room temperature, bimetallic switch 180 makes pressure contact with one end of contact wire 178. Contact wire 178 is supported by quartz rod 174 and is connected to lead-in conductor 62 of glow discharge starter 50.

The described lamp is connected, for example, through an inductive stabilization ballast to an a.c. power supply of approximately 220 volts, 60 hz. If the connection to the a.c. power supply is effected, a glow discharge is produced in glow discharge starter 50. If the heat generated by this glow discharge causes a deformation of the bimetallic electrode in the glow discharge starter so that the electrodes of the glow discharge starter contact one another, the glow discharge extinguishes and a current of higher intensity starts flowing through the stabilization ballast. If thereafter the glow discharge starter electrodes cool and disengage again, this current is abruptly interrupted; which results in a voltage peak between electrodes 160 and 162 of arc tube 142 causing arc tube 142 to ignite. Should this not happen the first time, then the starting procedure as described above is repeated. If the discharge in arc tube 142 starts, the voltage between electrodes 160 and 162 of arc tube 142 attains an operating voltage of approximately 90.0 volts. This value is below the value of the starting voltage of glow discharge starter 50 which causes glow discharge starter 50 to remain in the extinguished state. However, bimetallic switch 180 is present to provide an additional safety device. The starting circuit 182 is electrically removed from the circuit by opening of bimetallic switch 180, which occurs after a few seconds or minutes when bimetallic switch 180 is heated to its activating temperature, for example, 105° C., by the heat generated by the lamp.

While there have been shown and described what are at present considered to be the preferred embodiments of the invention, it will be apparent to those skilled in the art that various changes and modifications can be made herein without departing from the scope of the invention as defined by the appended claims.

I claim:

1. A glow discharge starter comprising an envelope having a seal located at one end thereof and containing an ionizable medium, a bimetallic electrode and a counter electrode located within said envelope, said electrodes defining a cylindrically shaped area therebetween extending longitudinally within said envelope from said seal to the other end of said envelope, and a getter holder located external to said area and secured to one of said electrodes and being adjacent the internal surface of said envelope, said getter holder comprising a getter holder strip having a getter cup formed therein or secured thereto for holding a predetermined amount of getter material, said getter cup having an opening and said opening faces said internal surface of said sealed envelope in a direction away from said bimetallic electrode.

2. The glow discharge starter of claim 1 wherein said bimetallic electrode comprises a connecting member having a contact means formed in or secured to one end of said connecting member, a bimetallic element having a first end secured to the other end of said connecting member and a second end secured to a post.

3. The glow discharge starter of claim 1 wherein said getter holder is secured to said counter electrode.

4. The glow discharge starter of claim 1 wherein said getter holder is secured to said bimetallic electrode.

5. An arc discharge lamp comprising:

an hermetically sealed outer envelope having a base portion at one end, with at least a pair of lead-in conductors extending therefrom into said envelope;

an hermetically sealed elongated arc tube disposed coaxially within said outer envelope, said arc tube having first and second external conducting terminals at respective first and second ends thereof respectively connected to electrodes disposed within said arc tube at said first and second ends thereof;

respective means within said outer envelope electrically connecting said pair of lead-in conductors to said first and second terminals of said arc tube, respectively; and a circuit for starting a discharge in said discharge tube electrically connected in series with said first and second terminals of said arc tube, said starting circuit including a glow discharge starter comprising an envelope having a seal located at one end thereof and containing an ionizable medium, a bimetallic electrode and a counter electrode located within said envelope of said glow discharge starter, said electrodes of said glow discharge starter defining a cylindrically shaped area therebetween extending longitudinally within said envelope of said glow discharge starter from said seal to the other end of said envelope of said glow discharge starter, and a getter holder located external to said area and secured to one of said electrodes of said glow discharge starter and being adjacent the internal surface of said envelope of said glow discharge starter, said getter holder comprising a getter holder strip having a getter cup formed therein or secured thereto for holding a predetermined amount of getter material, said getter cup having an opening and said opening faces said internal surface of said envelope of said glow discharge starter in a direction away from said bimetallic electrode.

6. The arc discharge lamp of claim 5 wherein said lamp is a high pressure sodium discharge lamp.

7. The arc discharge lamp of claim 5 wherein said glow discharge starter is located within said hermetically sealed outer envelope.

8. The arc discharge lamp of claim 5 wherein said bimetallic electrode comprises a connecting member having a contact means formed in or secured to one end of said connecting member, a bimetallic element having a first end secured to the other end of said connecting member and a second end secured to a post.

9. The arc discharge lamp of claim 5 wherein said getter holder is secured to said counter electrode.

10. The arc discharge lamp of claim 5 wherein said getter holder is secured to said bimetallic electrode.

11. The arc discharge lamp of claim 5 wherein said starting circuit further includes a bimetal switch in series combination with said glow discharge starter.

* * * * *